US005940907A

United States Patent [19]

Stoler et al.

[11] Patent Number: 5,940,907

[45] Date of Patent: Aug. 24, 1999

[54] FUTON FRAME

[76] Inventors: Kathleen S. Stoler; Chester L. Stoler, both of 3078 W. Owasso Blvd., Roseville, Minn. 55113

[21] Appl. No.: 08/589,092

[22] Filed: Jan. 19, 1996

[51] Int. Cl.[6] ..... A47C 17/17; A47C 17/04

[52] U.S. Cl. ..... 5/37.1; 5/47

[58] Field of Search ..... 5/37.1, 41, 47

[56] References Cited

U.S. PATENT DOCUMENTS

| | | | |
|---|---|---|---|
| 835,770 | 11/1906 | Williams . | |
| 2,294,475 | 9/1942 | McAllister | 5/47 |
| 2,319,337 | 5/1943 | McDaniel | 5/47 |
| 2,321,206 | 6/1943 | Holcomb | 5/47 |
| 2,324,675 | 7/1943 | Burton | 5/37.1 |
| 2,343,642 | 3/1944 | Burton | 5/37.1 |
| 3,634,893 | 1/1972 | Hern et al. | 5/37.1 |
| 4,642,823 | 2/1987 | Wiggins | 5/47 |
| 4,829,611 | 5/1989 | Fireman et al. | 5/47 |
| 4,875,244 | 10/1989 | Tremblay | 5/37.1 |
| 4,996,730 | 3/1991 | Fireman et al. | 5/37.1 |
| 5,146,640 | 9/1992 | Barton et al. | 5/47 |
| 5,664,268 | 9/1997 | Stoler et al. | 5/37.1 |

*Primary Examiner*—Alex Grosz
*Attorney, Agent, or Firm*—Jacobson & Johnson

[57] ABSTRACT

A futon frame having side members with guide slots having a vertical riser and a transverse riser and a pair of pad support members movable with respect to the guide slots with one of the pad support members having projections for following in the guide slots and the other pad support member pivotally connected thereto and laterally engageable with the futon frame to normally hold the pad support members in the bed position with the futon frame being convertible to the bed position by first lifting a free end of one of the pad support members and then lowering the free end of one of the pad support members to allow the projections on the pad support member to elevationally follow the guide slots until the pad support members are located in a couch position.

9 Claims, 7 Drawing Sheets

FUTON FRAME

FIELD OF THE INVENTION

This invention relates generally to futon frames and, more specifically, to improvements to futon frames enabling quick conversion of a futon frame from a bed position to a couch position by lifting and than lowering one of the pad support members.

BACKGROUND OF THE INVENTION

The concept of devices for tilting a sofa bed or futon frame between a bed position and a couch position are old in the art. Typically, the end frames have guide slots with one set of guide slots having a L-shape with a roller that must first be moved laterally along the lower portion of the L-shaped slot before the roller can be moved upward to convert the bed into a couch. A purpose of the L-shape slot is to provide a lock for the futon frame to maintain the futon in the bed position. Unfortunately, the locking also requires one to unlock the frame by having to laterally displace the pad support member before the unit can be converted into a couch. This problem is specifically pointed out in U.S. pat. No. 4,829,611 where in column 4 lines 30 to 35 he states "It may be necessary to pull or jiggle the engaged seat frame 17 and back frame 18 so that they are unlocked in their horizontal positions with the bearings 26 and 27 engaged in the horizontal components of the respective guide channels 31 and 32." The present invention addresses the problem of having to unlock the frame before converting the futon from the bed position to the couch position by providing guide slots that initiate movement of the futon from the bed position to the couch position by merely lifting the pad free of the cross rail yet during normal use of the futon as a bed the guide slots and cross rails coact with the pad support members to retain the futon in the bed position.

DESCRIPTION OF THE PRIOR ART

U.S. Pat. No. 5,146,640 shows a latching assembly for a sofa bed which uses pawls to hold the scat and back in position.

U.S. Pat. No. 4,996,730 shows a sofa bed recliner with a mechanism which allows the back member to move forward as a user converts the unit from a couch to a bed.

U.S. Pat. No. 4,829,611 shows a sofa bed recliner with a detent which locks the frames to allow movement from a horizontal to a vertical condition.

U.S. Pat. No. 835,770 shows a convertible couch and bed with pivoting links for movement from a couch position to a seat position.

U.S. Pat. No. 2,343,642 shows a latch and dog arrangement for holding the back in relation to the seat.

U.S. Pat. No. 2,324,675 shows a further embodiment of the latch and dog arrangement of U.S. Pat. No. 2,343,642.

U.S. Pat. No. 4,875,244 shows sofa bed with a triangular block for engaging the back and seat area with each other.

U.S. Pat. No. 3,634,893 illustrates a sofa bed utilizing a pair of reaction plates to adjoin the seat and back areas together.

U.S. Pat. No. 4,642,823 depicts a sofa bed wherein the backrest engages forward upon formation of the bed.

U.S. Pat. No. 2,321,206 shows a sofa bed with seat and back not mechanically connected with one another.

U.S. Pat. No. 2,319,337 depicts a sofa bed wherein the back and seat are connected by permanent fixed bolts.

U.S. Pat. No. 2,294,475 illustrates a sofa bed with back and seat members engaging one another by means of an attached side plate.

SUMMARY OF THE INVENTION

Briefly, the invention comprises a futon frame having arms with guide slots having a vertical riser and a transverse riser and a pair of pad support members movable with respect to the guide slots with one of the pad support members having projections for following in the guide slots and the other pad support member pivotally connected thereto and laterally engageable with the futon frame to normally hold the pad support members in the bed position with the futon frame being convertible to the bed position by first lifting a free end of one of the pad support members and then lowering the free end of one of the pad support members to allow the projections on the pad support member to elevationally follow the guide slots until the pad support members are located in a couch position.

DESCRIPTION OF THE PREFERRED EMBODIMENT

Figure 1:
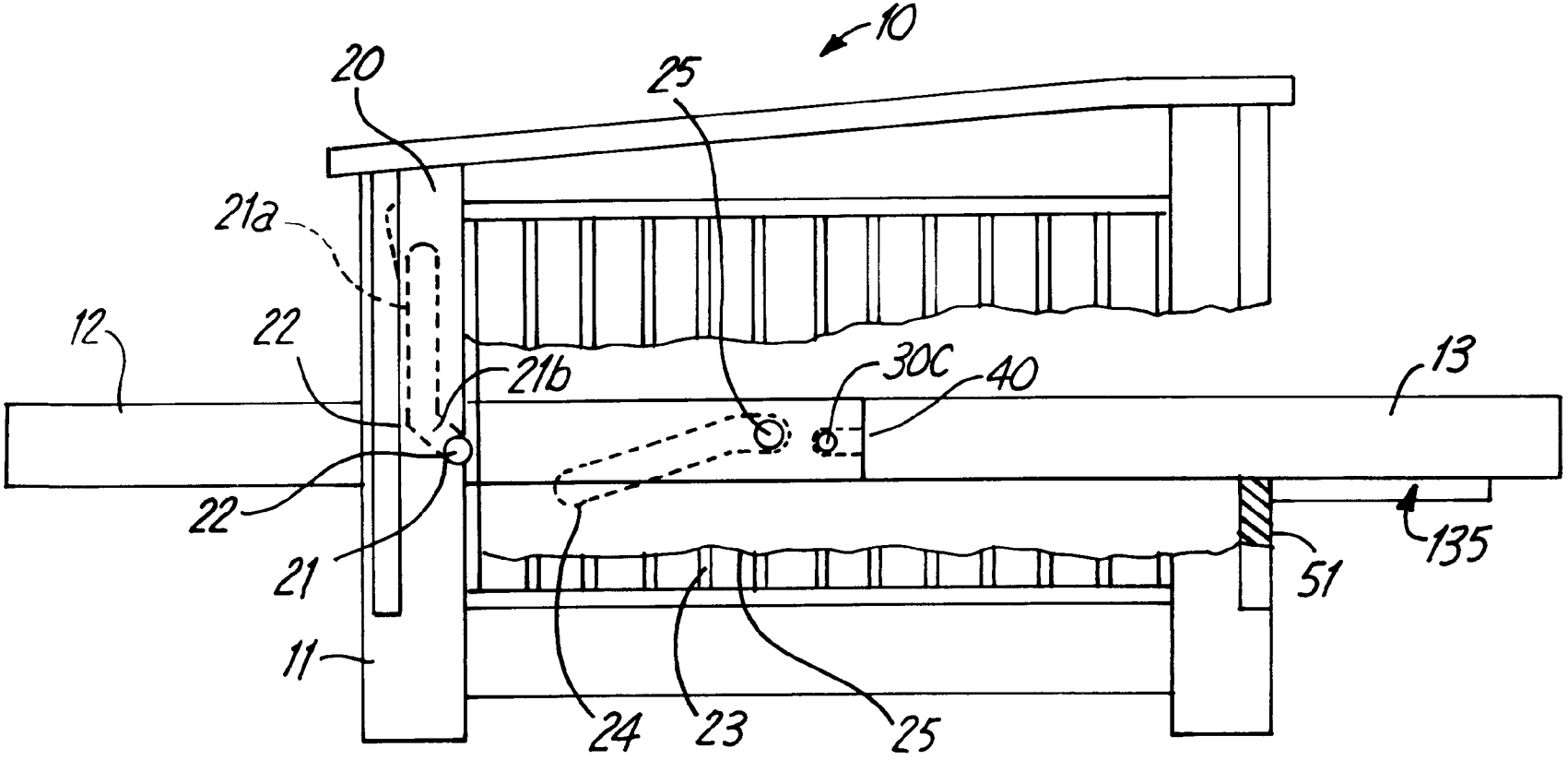
FIG. 1 shows a partial cutaway side view of the futon of the present invention in the bed position.

Referring to FIG. 1 reference numeral 10 identifies a futon frame having a first arm 11.

Figure 11:
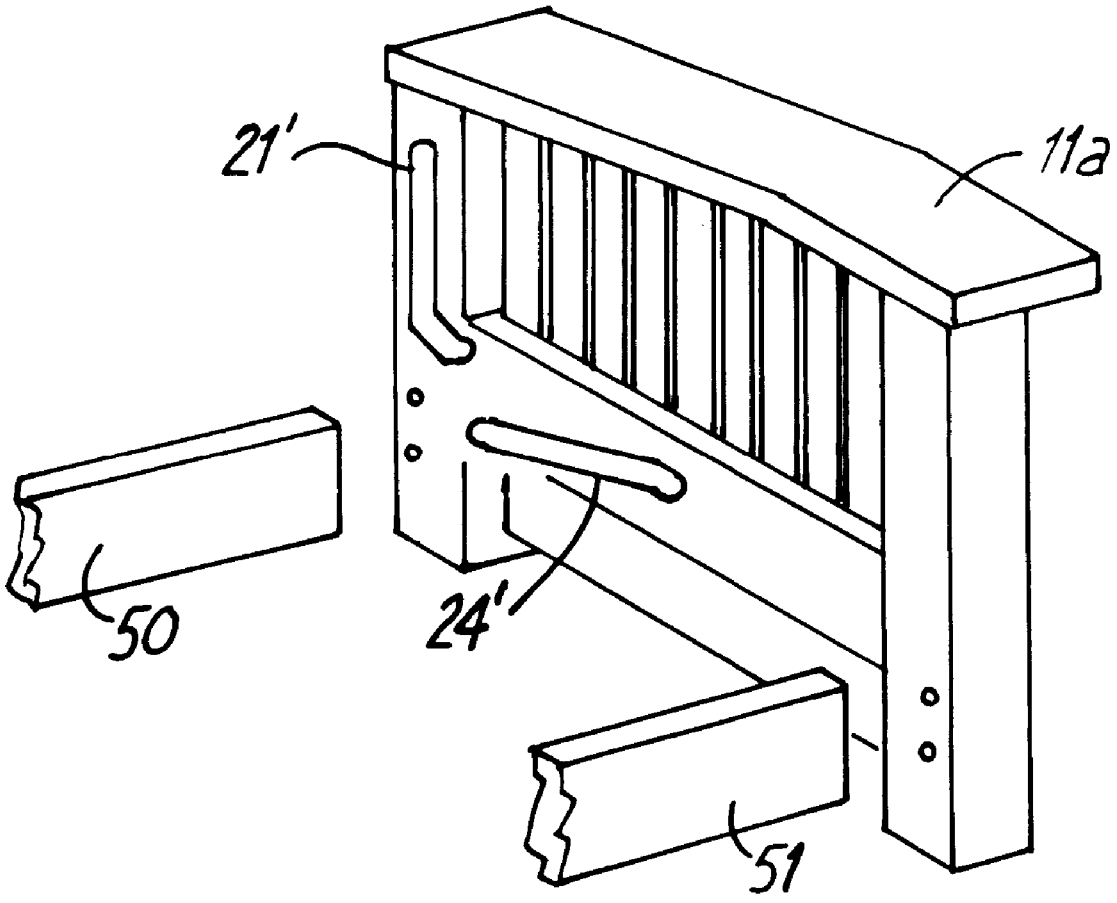
FIG. 11 shows a perspective view of one of the arms of the futon.

Extending laterally outward from arm 11 is a first pad support member 12 and a second pad support member 13. FIG. 11 shows a second arm 11*a* with cross rails 50 and 51 that connects arm 11 to arm 11*a* to form a rectangular frame for supporting the pad support members. Arm 11 includes a first guide slot 21 shown in dashed lies for engaging a roller 22 attached to the side of pad support member 12 and a second guide slot 24 for engaging a second roller 25.

Similarly, arm 11*a* on the opposite side (FIG. 11) includes identical guide slots 21' and 24' for supporting corresponding rollers on the opposite side of pad support member 12.

Figure 5:
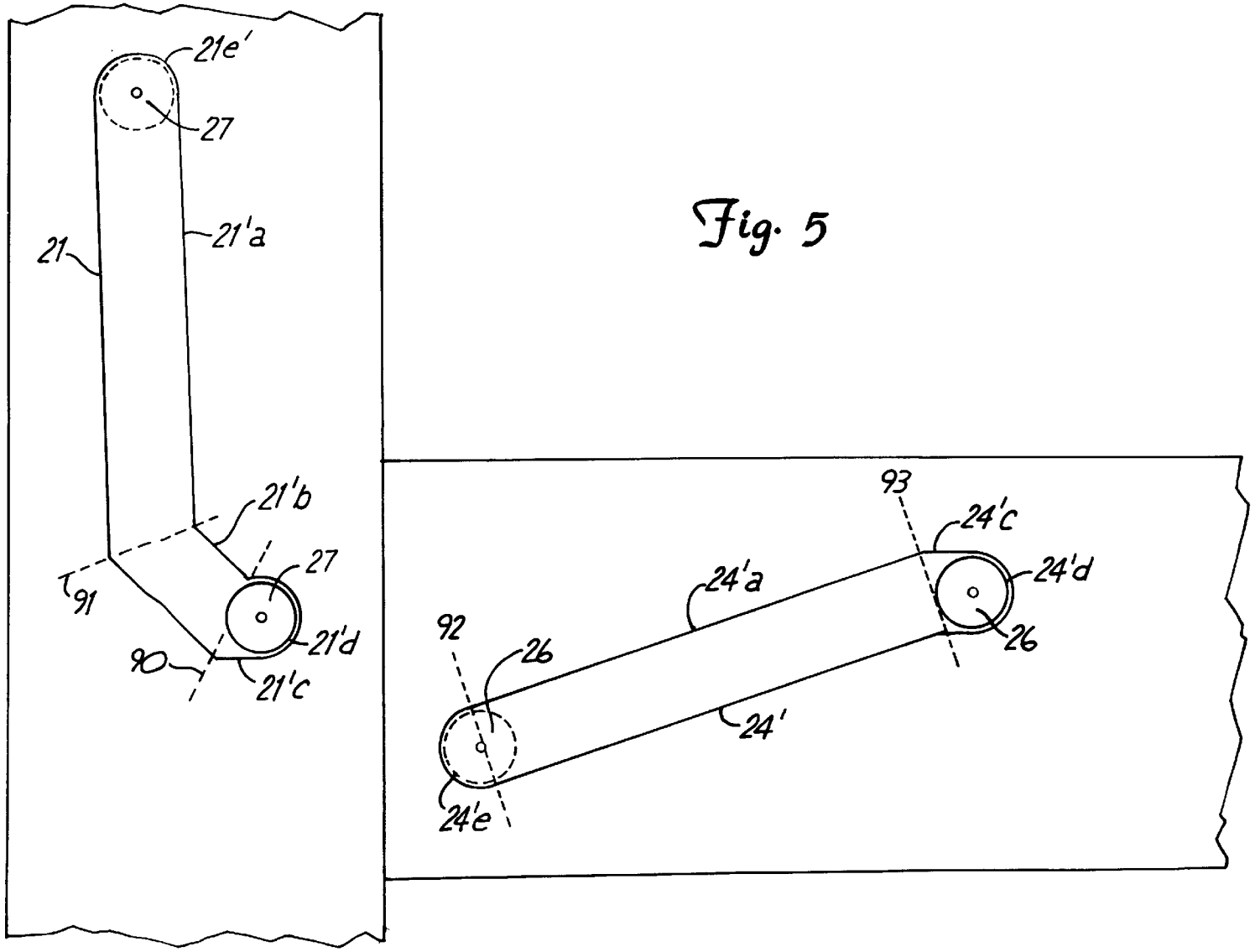
FIG. 5 shows a front view of a portion of the futon frame to show the guide slots for moving the pad support members from the couch position to the bed position and vice a versa.

FIG. 5 shows guide slots 21' and 24' in greater detail. As the corresponding guide slots 21 and 24 are identical only guide slots 21' and 24' are described herein. First guide slot 21' includes a bed stop 21*d*' formed by the end of guide slot 21', a lower lateral guide surface 21'*c*, a transverse riser 21'*b* which is located between dashed lines 90 and 91 and a vertical riser 21'*a* which terminates in a curved couch stop 21'*e*. The second guide slot 24' includes a bed stop formed by curved end 24'*d*, an upper lateral guide surface 24'*c*, a transverse guide 24'*a* which is located between the dashed lines 92 and 93 and a couch stop formed by curved end 24'*e*. The projections 26 and 27, which are rollers, 26 and 27 are movable between the bed position (illustrated by solid lines) to the couch position (illustrated by dotted lines). The guide slots 21 (FIG. 1) and 21' (FIG. 11 )are arranged so that the projections 22 and 27 can begin to elevate along transverse risers 21*b* and 21*b*' as soon as one of the pad support members is lifted upward. The projections 22 and 27 can continue to elevate along vertical risers 21*a* and 21'*a* until the rollers 22 and 27 are in the couch position (illustrated in FIG. 5 by rollers 22 and 27 in dashed lines).

Figure 2:
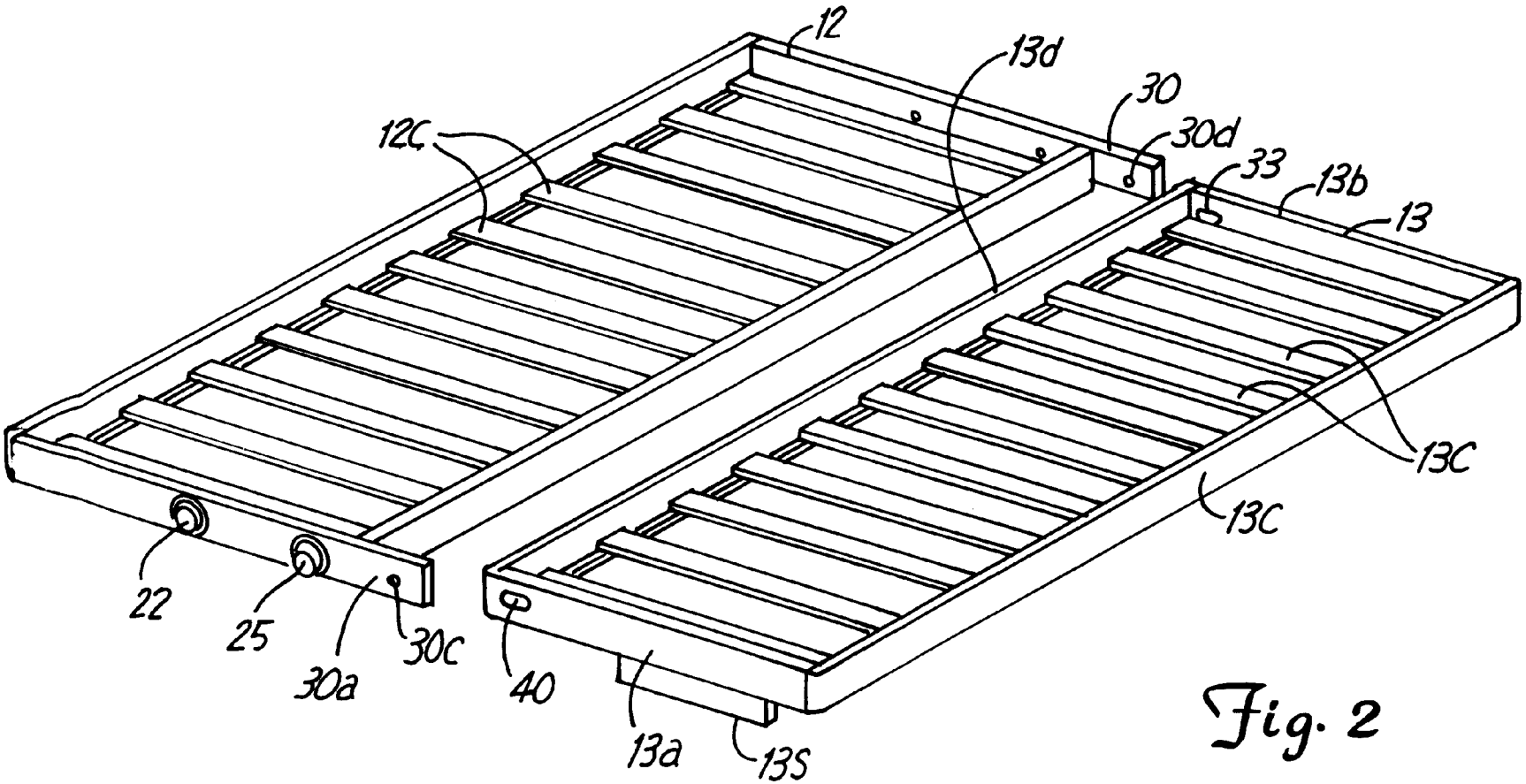
FIG. 2 shows a perspective view of the pad support members of the present invention in the unassembled position.

FIG. 2 shows the pad support members 12 and 13 in the unassembled position. In the embodiment shown, pad support member 12 could be the back rest frame member and pad support member 13 could be the seat frame member when the futon frame is converted into a couch. One end of pad support member 12 includes a first extension 30*a* with an opening 30*c* therein. Similarly, the opposite end of pad support member 12 includes a second extension 30 with an opening 30*d* therein. Pad support member 13 includes a front cross member 13*c*, a rear cross member 13*d* and two end members 13*a* and 13*b* and slats 14*c*. End member 13*a* includes an elongated opening 40 and similarly end member 13*b* includes an elongated opening 33. Pad support member 13 is sufficiently smaller in width than pad support member 12 to allow end members 13*a* and 13*b* to be held between first extension 30*a* and second extension 30 with free movement between the pad members with respect to each other. Located on the bottom of pad support member 13 is a first stop 13*s* and a second stop (not shown) which form engagement with cross rail 51. One end of stop 13*s* is engageable with cross rail 51 when the pad support members is in the bed position and the other end of stop 13*s* is engageable with cross rail 51 when the pad members are in the couch position.

Figure 3:
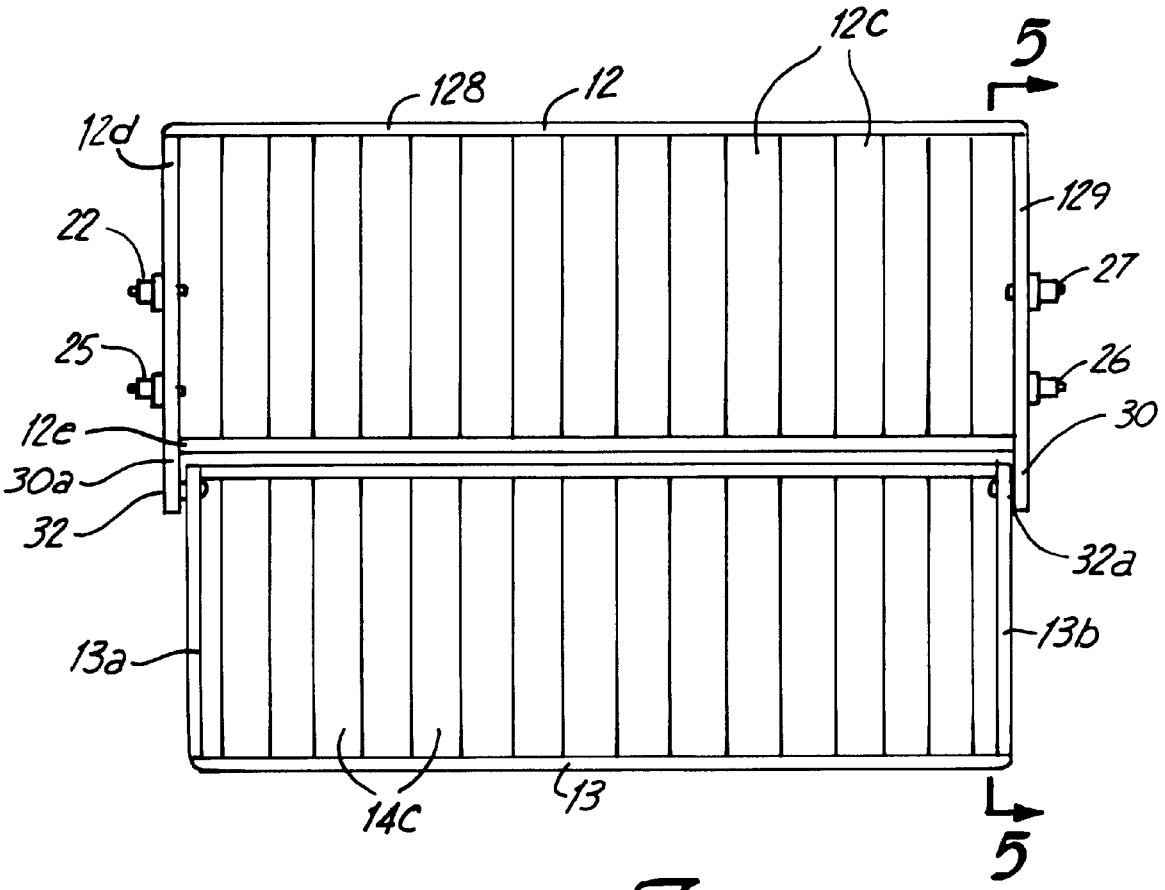
FIG. 3 shows a top view of the pad support members of the present invention in the bed position with the pad support members located in pivotal engagement with each other.

FIG. 3 shows the pad support members 12 and 13 in the assembled position. In the assembled position a pin 32 connects extension 30*a* to end member 13*a* and similarly a pin 32*a* connects extension 30 to end member 13*b*. Pad support member 12 includes side members 12*d* and 12*g*, and cross members 12*f* and 12*c* and a set of slats 12*c*. Similarly pad support member 13 includes slats 14*c* for supporting a futon pad thereon. Located on one side of pad support member 12 are rollers 22 and 25 and located on the opposite side of pad support member 12 are rollers 26 and 27.

Figure 4:
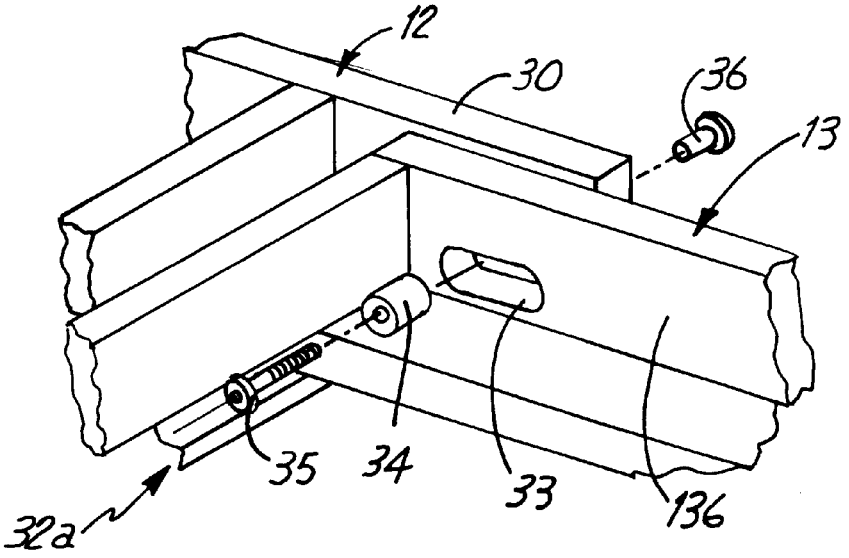
FIG. 4 shows a partial view of the pivotal members that connect the pad support members to each other.

FIG. 4 shows a partial sectional and exploded view of the pin 32*a* that connects extension 30 to member 13*b*. As pin 32 is identical, only pin 32*a* will be described. Pin 32*a* comprises a bolt 35, a nylon roller 34 that fits around bolt 35 and a cap nut 36 for securing to threads of bolt 35. In the assembled position roller 34 is positioned within elongated guide slot 33 to permit lateral displacement of end member 13*b* with respect to extension 30. Similarly, pin 32 is position with respect to elongated slot 40 to permit lateral displacement of end member 13*a* with respect to extension 30*a*.

FIGS. 6 through 10 show a schematic of how the futon frame is converted from the bed position to the couch position. FIG. 5 is taken along lines 5—5 of FIG. 3 to illustrate the relationship of pad support members 12 and 13 during the repositioning of the couch. To illustrate how pad 12 moves with respect to the backrest guide slots in the end frame the slots in the end frame 11 are illustrated as 21' and 24'. The rollers 27 and 26 which are located on the right side of pad 12 are illustrated in their various positions in regard to the back rest guide slots 21' and 24' so that the action of converting the futon from a bed to a couch position can be illustrated.

Figure 6:
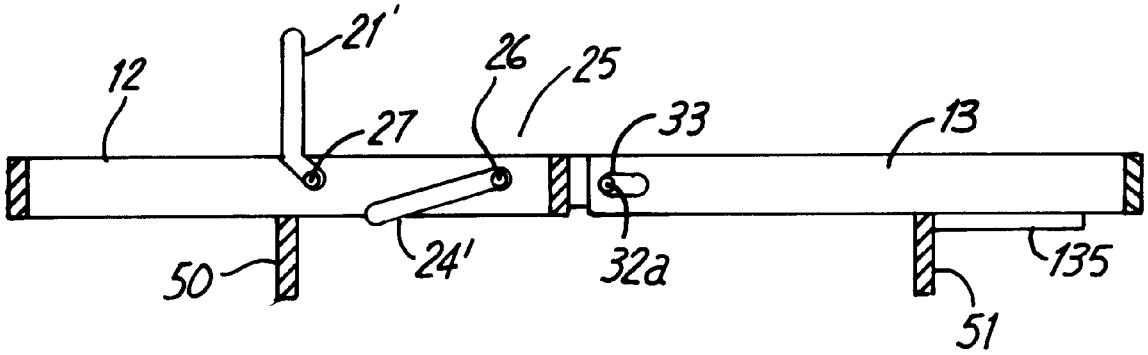
FIG. 6 shows the pad support members of FIG. 3 with the members extended from each other in an unlocked position to initiate the process of converting the bed into a couch.

FIG. 6 shows pad support member 12 and pad support member 13 in an end to end relationship with each other. In this position pin 32*a* is located in the far left end of elongated slot 33. Pad support member 12 is supported by cross rail 50 and pad support member 13 is supported by cross rail 51. One end of lateral stop 13*s* engages cross rail 51 to prevent lateral displacement of pad support member 13 while bed stop 21'*d* in guide slots 21' and 24' prevent lateral displacement of pad support member 12.

Figure 7:
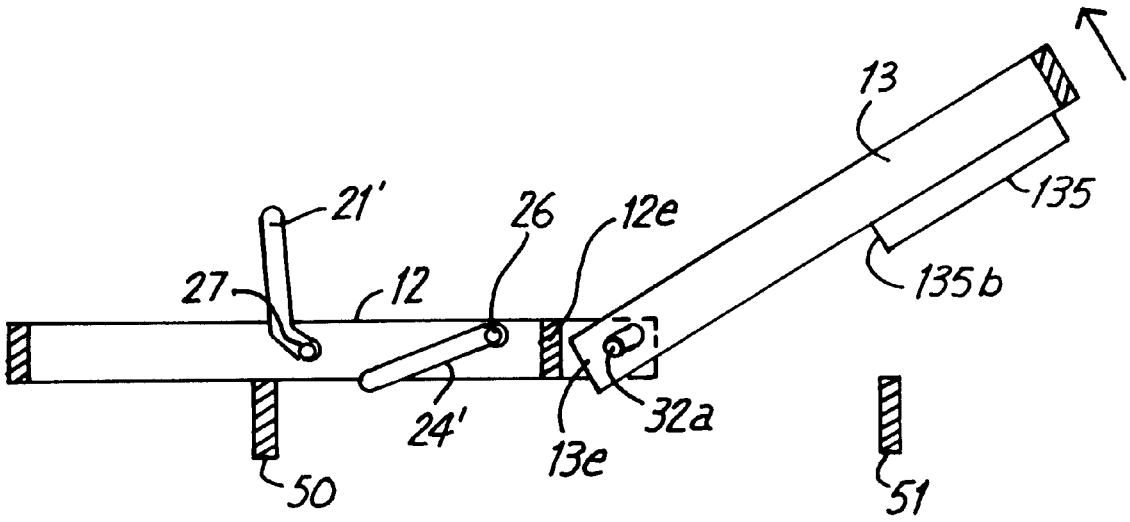
FIG. 7 shows the pad support members of FIG. 5 with one of the pad support members pivoted upward.

FIG. 7 shows that the free end of pad support member 13 being elevated upward by rotating pad support member counterclockwise about pin 32*a*. In this condition the end member 13*d* clears end member 12*e* to permit the upward rotation of pad support member 13. Also stop end 13*sb* moves free of cross rail 51 thus automatically unlocking the pad support member from the bed position. That is, the lifting of free end of pad support member 13 disengages the lateral stop 13*s* from cross rail 51 thus allowing the conversion from the bed position to the couch position through upward and downward movement of the free end of pad support member 13.

Figure 8:
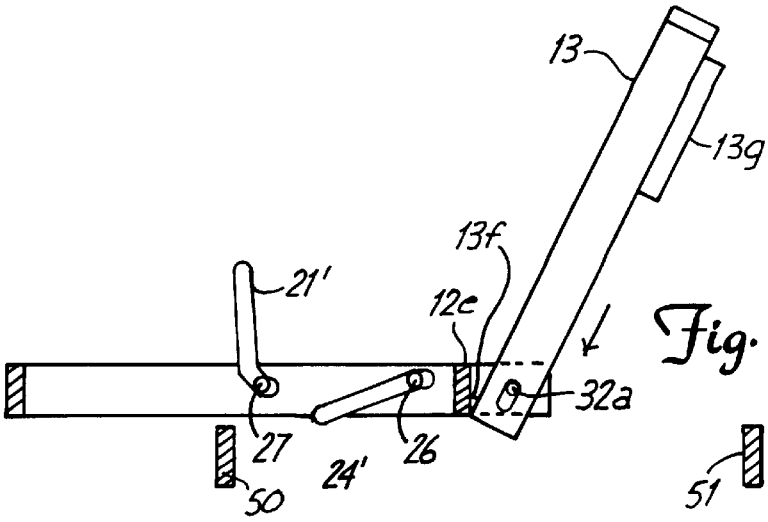
FIG. 8 shows the pad support members of FIG. 5 with one of the pad support members pivoted upward sufficiently far so as to form a lever type engagement with the other pad support member.

FIG. 8 shows that pad support member 13 has been rotated sufficiently so that the top edge 13*f* of pad support member 13 sits in engagement with member 12*e* of pad support member 12. Note the weight of pad support member 13 causes pad support member 13 to slide downward along pin 32*a* thus putting pin 32*a* at the top of elongated slot 33. In this condition, the two pad support members 12 and 13 are no longer in clearing relationship to each other but are in a temporary interlocking engagement with each other.

Figure 9:
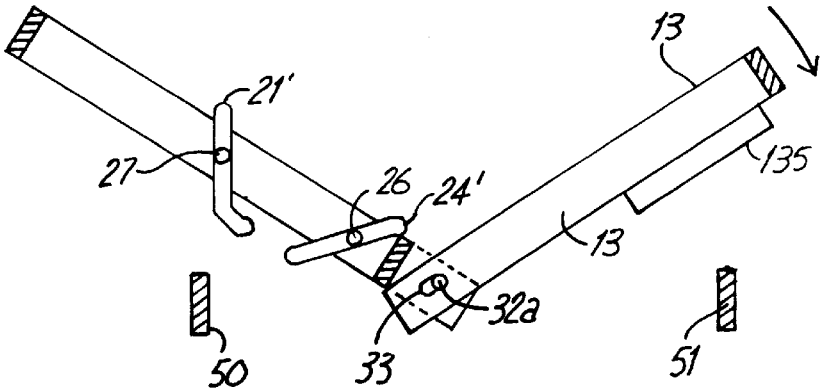
FIG. 9 shows the pad support members of FIG. 5 with one of the pad support members being used as a lever to move the other pad support member.

FIG. 9 shows pad support member 12 being rotated clockwise as pad support member 13 is temporarily used as a lever arm. Note that as the pad support member 12 is pivoted upward with the guide rollers 27 and 26 move along the slots 21' and 24' respectively. Thus the application of a lever like force to one end of pad support member 12 causes pad support member 12 to move from the horizontal position toward an upright position with the movement of the pad support member 12 being controlled by back rest guide slots 21' and 24'

Figure 10:
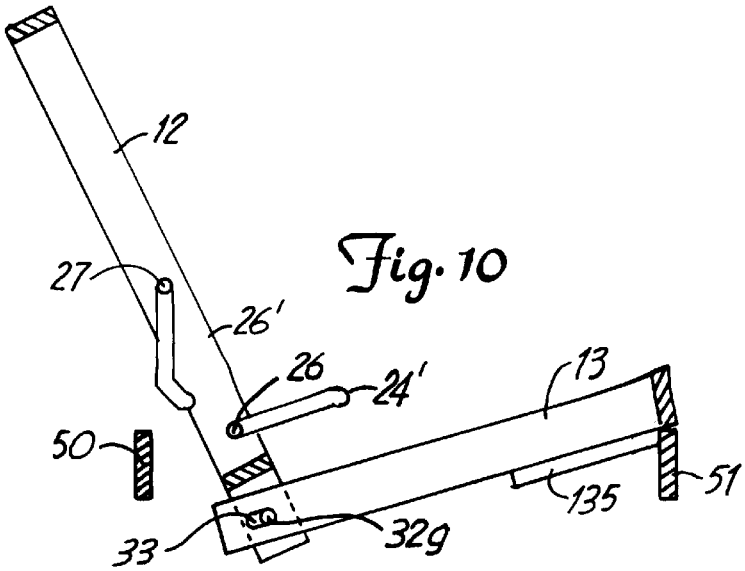
FIG. 10 shows the pad support members of FIG. 5 with one of the pad support members located in the back rest position and the other in the seat cushion position.

FIG. 10 shows that continued clockwise movement of pad support member 13 forces pad support member 12 to move to the backrest position and pad support member 13 to the seat position. In the seat position the opposite end of lateral stop 13*s* engages the back side of rail 51 to hold the pad support member 13 in the couch position. Thus, from viewing of FIG. 6 to FIG. 10 it is apparent that all one has to do to move the futon frame from a bed position to a couch position is lift the free end of pad support member 13, rotate it upward until the pad support member 13 interlocks with pad support member 12, push down on the free end of pad support member 13 to raise the pad support member 12 and bring the unit into the couch position, wherein pad support member 12 acts as a back rest and pad support member 13 acts as a seat cushion.

If one wants to covert the unit from the couch position to the bed position the user lifts up on the free end pad support member 13 to disengage stop 13*s*. The user than pulls on pad support member 13 causing pad support member 12 to move with respect to back rest guide slots 21' and 24'. That is, a pulling force on pad support member 12 pulls pad support members 12 and 13 free of interlocking relationship to permit the pad support member 12 and pad support member 13 to move to the horizontal position shown in FIG. 6.

We claim:

1. A futon frame for converting from a bed position to a couch position and automatically locking comprising:

a frame (10) including a cross rail (51), said frame having a first set of guide slots (21', 24') and a second set of guide slots (21, 24) therein, said first set of guide slots each having a transverse riser (21*b*') and a vertical riser (21*a*') with a couch stop (21'*e*);

a first pad support member (12), said first pad support member including a first set of oppositely disposed projections (26, 27) for engaging said first set of guide slots and a second set of oppositely disposed projections (22, 25) for engaging said second set of guide slots to permit displacement of said first pad support member with respect to said frame;

a second pad support member (13), said second pad support member pivotally connected to said first pad support member, said second pad support member having a free end (13*c*);

a set of lateral stops (13*s*) located on the bottom of the second pad support member, each lateral stop having one end engagable with a cross rail (51) to retain the second pad support member in a support position, and each lateral stop having a second end engagable with cross rail (51) to retain the second pad support member in a couch position; and a further couch stop located in said second set of guide slots with said second set of guide slots spaced from said first set of guide slots so that when the first set of oppositely disposed projections are located in said first set of guide slots and said second set of oppositely disposed projections are located in said second set of guide slots, the elevation of the free end of said second pad support member causes said first set of oppositely disposed projections to initiate travel upward and laterally in said tranverse riser and the further elevation and lower of the free end of said second pad support member causes said first set of oppositely disposed projections to move upward in said vertical riser into engagement with the couch stop to thereby position said first pad support member and said second pad support pad support member in a couch position.

2. The futon frame of claim 1 wherein the projections include rollers (22, 25, 26, 27) for displacement within the respective guide slots.

3. The futon frame of claim 1 wherein the first pad support member and said second pad support member include slats (14*c*, 12*c*) for supporting a portion of a pad thereon.

4. The futon frame of claim 3 wherein the first pad support member and said second pad support member are made of wood.

5. The futon frame of claim 4 wherein the frame includes arm rests (11, 11*a*) secured thereto.

6. The futon frame of claim 5 including cross rails (50, 51) for engaging said arm rests to form a box like frame for said pad support members.

7. The futon frame of claim 1 wherein the transverse riser in the first set of guide slots is at an angle of about 45 degrees to the vertical risers.

8. The futon frame of claim 7 wherein the futon frame is made of wood and the pad support are made of wood.

9. A futon frame for tilting from a bed position to a couch position and vice versa comprising:

a frame with a first and second cross rail (50, 51); and a first pad support member (12) and a second pad support member (13), said second pad support member including a lateral bed stop (13*s*) for engaging the first cross rail and retaining the pad support member in the bed position with the pad support member being displaceable with respect to said rail to free said pad support member from lateral engagement to thereby enable said second pad support member to form a lever arm for engaging said first pad support member to enable the second pad support member to be used as a lever to raise the first pad support member from a horizontal position to a generally vertical position to thereby convert the futon from a bed to a couch, the stop member having one end engagable with the first cross rail to retain the second pad support in a bed position, and a second end engagable with the first cross rail to retain the second pad support member in a couch position.

* * * * *